US005405026A

United States Patent [19]

Lee et al.

[11] Patent Number: 5,405,026

[45] Date of Patent: Apr. 11, 1995

[54] CLOTHES HANGER ROD SHELF ATTACHMENT

[75] Inventors: E. Desmond Lee, St. Louis; William D. Arnold, Florissant; Charles Camilleri, St. Louis; Steve D. Johnston, Cape Girardeau, all of Mo.

[73] Assignee: Lee Rowan Company, St. Louis, Mo.

[21] Appl. No.: 148,650

[22] Filed: Nov. 1, 1993

[51] Int. Cl.[6] ..... A47F 5/00

[52] U.S. Cl. ..... 211/123; 211/106; 211/181

[58] Field of Search ..... 211/90, 106, 105.1, 211/123, 181; 108/29

[56] References Cited

U.S. PATENT DOCUMENTS

| | | | |
|---|---|---|---|
| D. 295,344 | 4/1988 | Pryor et al. . | |
| D. 324,783 | 3/1992 | Greenhut et al. . | |
| 505,360 | 9/1893 | Hilliard . | |
| 1,486,773 | 3/1924 | McClain | 211/106 |
| 2,271,784 | 2/1942 | Tritt . | |
| 2,859,879 | 11/1958 | Rogers et al. . | |
| 3,120,309 | 2/1964 | Goettl et al. . | |
| 3,688,915 | 9/1972 | Ramsey . | |
| 4,493,423 | 1/1985 | Kaeslin et al. . | |
| 4,671,419 | 6/1987 | Beverly . | |
| 4,825,504 | 5/1989 | Camilleri . | |
| 4,884,702 | 12/1989 | Rekow | 211/90 |
| 5,050,750 | 9/1991 | Mason . | |
| 5,104,080 | 4/1992 | Berger | 211/90 X |

FOREIGN PATENT DOCUMENTS 164969 10/1958 Sweden .

*Primary Examiner*—Robert W. Gibson, Jr.

*Attorney, Agent, or Firm*—Rogers, Howell & Haferkamp

[57] ABSTRACT

The present invention provides a clothes hanger rod attachment to be used in combination with wire shelves so as to allow uninterrupted slidability of clothes hangers while retaining strength, durability, low cost, and ease of manufacture. The attachment may be readily used in conjunction with existing wide web and narrow web wire shelving configurations.

20 Claims, 1 Drawing Sheet

CLOTHES HANGER ROD SHELF ATTACHMENT

BACKGROUND AND SUMMARY OF THE INVENTION

This invention relates to a clothes hanger rod attachment for use in combination with wire shelves. The hanger rod attachment is comprised of a hanger rod, a spacer rod, and a plurality of support brackets that allow uninterrupted sliding of garment hangers along the hanger rod.

Clothes hangers typically have hooks for suspending the hanger from a rod. It is commonly recognized that clothes hangers should be freely slidable on the rod. This free and uninterrupted slidability is desirable so that the hangers may be slid along the rod as hangers are added to and removed from the rod as well as to view the clothes.

In the past, this slidability has been accomplished with relatively large diameter wooden rods or metal pipes supported at their ends. However, longer rods and pipes require that brackets supporting the rod be attached to the rod intermediate its opposite ends to prevent sagging, but these support brackets interfere with the free slidability of the hangers. These prior art rods also have the disadvantage of being relatively expensive.

More recently, wire shelves with integral clothes hanger rods have been developed. However, the small diameter of the wire shelf hanger rods requires support brackets be spaced along the hanger rod to prevent the rod from sagging. These brackets interfere with the free slidability of clothes hangers on the rod. Still more recently, wire shelves have been developed with rod support brackets which are configured so as not to interfere with the slidability of clothes hangers. Unfortunately, replacing existing wire shelving with this improved shelving is very expensive.

In order to solve these and other problems in the prior art, the present invention provides an inexpensive and convenient-to-install hanger rod attachment formed of wire support brackets and rods welded together. The hanger rod attachment may be removably attached to existing wire shelves by a plurality of the support brackets which hook over the two transverse wire shelf rods commonly provided along the front of wire shelving. Because the clothes hanger rod, like the transverse shelf rods, has a relatively small thickness, the support brackets are spatially arranged along the length of the hanger rod to prevent the hanger rod from sagging. With a proper number of support brackets suspended from the shelf and welded to the clothes hanger rod, many clothes hangers can be hung from the clothes hanger rod with minimal sagging of the hanger rod.

In accordance with the present invention, there is provided a transverse hanger rod for hanging clothes hangers, a plurality of support brackets for suspension of the rod below the wire shelving, and a second spacer rod for rigidity and maintenance of the spacing of the support brackets. The support brackets have integral upper and lower hook sections. As a matter of function, the upper hooks are narrower than the lower hook sections. The lower hook section is positioned rearward and downward from the hanger rod and the end of the lower hook section is welded to the hanger rod. This configuration permits clothes hangers to slide across the hanger rod past the support brackets without being obstructed by them. For rigidity, the spacer rod is welded to the upper hook sections near the intersection of the upper and lower hook sections. The open end of the upper hook section extends downward to permit easy connection to wire shelving which are well-known in the art. Together, the upper and lower hook sections form a continuous stem of the support bracket that is preferably formed from a single bent wire.

Several other advantages of the current invention may not be as readily apparent. For instance, the attachment does not require fasteners of any type which results in a quick conversion without the need for tools. Also, the spacing of the brackets permits connection to both wide web and narrow web wire shelving configurations. Unlike larger dimensioned rods, the attachment of the present invention can be easily cut with a pair of pliers, rather than cut with a saw, to a length making installation more convenient. Finally, the hanger rod is spaced forward of the upper hook contact points so as to prevent the attachment from rattling during use.

While the principal advantages and features of the present invention have been briefly described above, a greater understanding of the novel and unique features of the invention may be attained by referring to the drawings and Description Of The Preferred Embodiment which follow.

DETAILED DESCRIPTION OF THE PREFERRED EMBODIMENT

Figure 1:
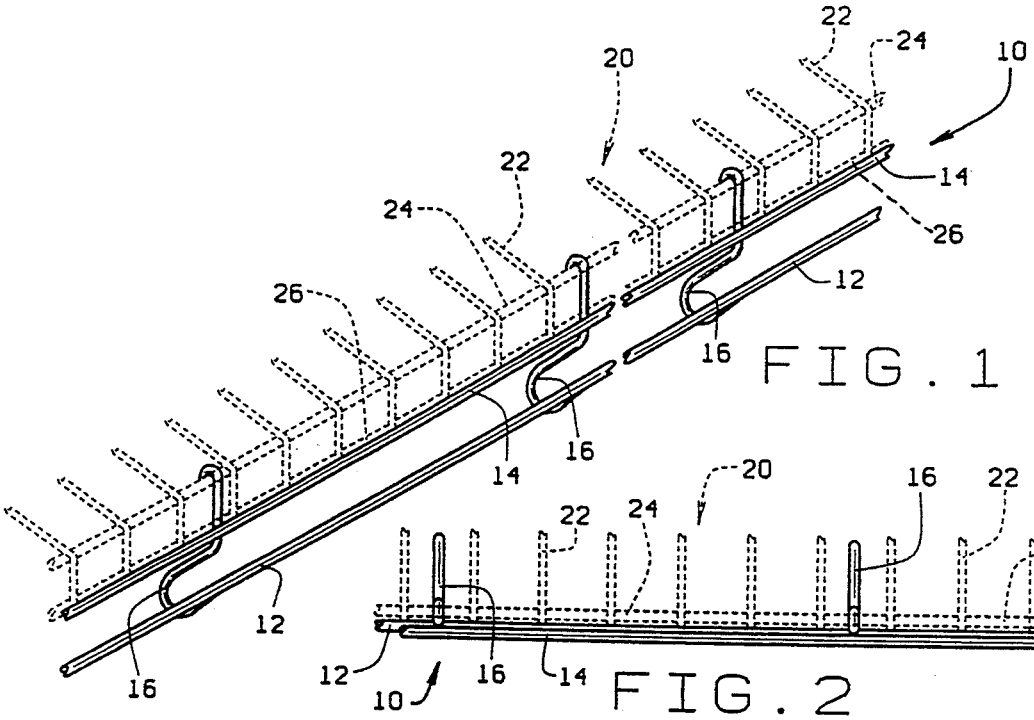
FIG. 1 is a perspective, fragmented view of the clothes hanger rod attachment of the present invention attached to a portion of a wire shelf shown in phantom.
Figure 2:
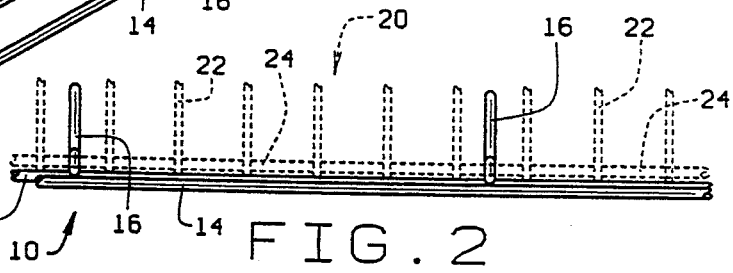
FIG. 2 is a top plan view of the clothes hanger rod attachment of the present invention, with a portion of a wire shelf shown in phantom.
Figure 3:
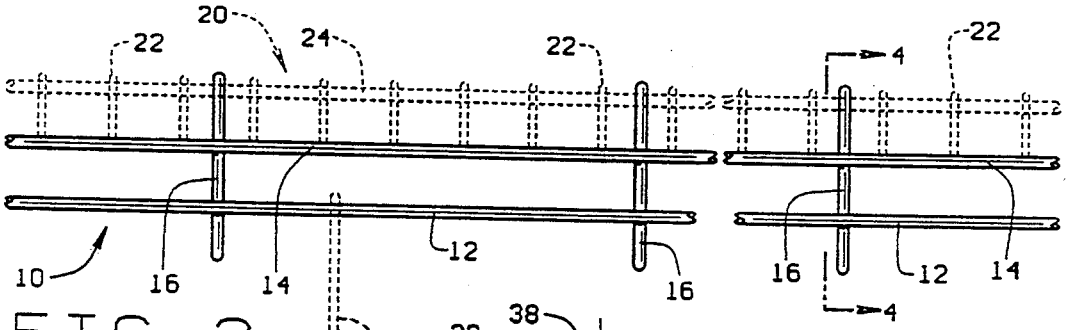
FIG. 3 is a front elevation view of the clothes hanger rod attachment of the present invention, with a wire shelf and a hook portion of a clothes hanger shown in phantom.

The clothes hanger rod shelf attachment 10 of the present invention is generally comprised of a clothes hanger rod 12, a spacer rod 14, and a plurality of support brackets 16. The hanger rod attachment 10 is specifically designed to be easily attached to existing wire shelving with no need for tools or fasteners. All of the component parts of the assembly are constructed of small diameter rods or wires of the type used in the construction of known wire shelving and storage units. This enables the hanger rod shelf attachment of the invention to be easily cut to any desired length to match the length of the wire shelf to which it is to be attached.

The hanger rod 12 and spacer rod 14 are substantially identical to each other, with the exception being that the spacer rod 14 has a slightly smaller cross section diameter than that of the hanger rod 12. Both the hanger rod and spacer rod extend parallel to each other in straight lines between their opposite ends for a predetermined length. The length of both the hanger rod and spacer rod can be chosen to match common lengths of wire shelving units to which the clothes hanger rod shelf attachment 10 of the invention is intended to be attached. However, the small diameter of both the hanger rod 12 and spacer rod 14 enables the clothes hanger rod shelf attachment 10 of the invention to be cut to any desired length to match the hanger rod attachment to a wire shelf of any particular length.

Each of the support brackets 16 are substantially identical to each other and so only one support bracket will be described in detail herein. As seen in the drawing figures, the plurality of support brackets 16 are attached to both the hanger rod 12 and spacer rod 14 in a spatial arrangement of the brackets along the lengths of these two rods. The spacing between adjacent support brackets is chosen to provide sufficient support to the hanger rod 12 to prevent its downward sagging or bending with several clothes hangers 18 suspended from the rod in use of the rod attachment 10. The spacing arrangement of the support brackets 16 is also chosen to enable the rod attachment 10 of the invention to be used with a variety of different wire shelf assemblies 20 available from different manufacturers. Typically, wire shelf assemblies are constructed with a one-half inch or one inch spacing between the parallel wires 22 that make up the support surface of the shelf assembly. By spacing each of the plurality of support brackets 16 a given number of inches apart, the hanger rod shelf attachment 10 of the invention may be easily retrofit to the conventional wire shelf assembly. Furthermore, as shown in the drawing figures, known wire shelf assemblies 20 typically employ one or two transverse rods 24, 26 that extend across the front of the wire shelf assembly in a horizontally spaced relation. The transverse rods are secured to the downwardly bent forward ends of the parallel wires 22 that make up the support surface of the shelf assembly. As will be explained, the configuration of each of the support brackets 16 is designed to enable the support brackets of the hanger rod shelf attachment 10 to be easily attached over both of the forward transverse rods 24, 26 of the wire shelf assembly without the need for separate fasteners or known types of fastener assemblies. This enables the hanger rod shelf attachment of the present invention to be easily retrofit to an existing wire shelf assembly 20 and easily removed from the wire shelf assembly if so desired.

Figure 4:
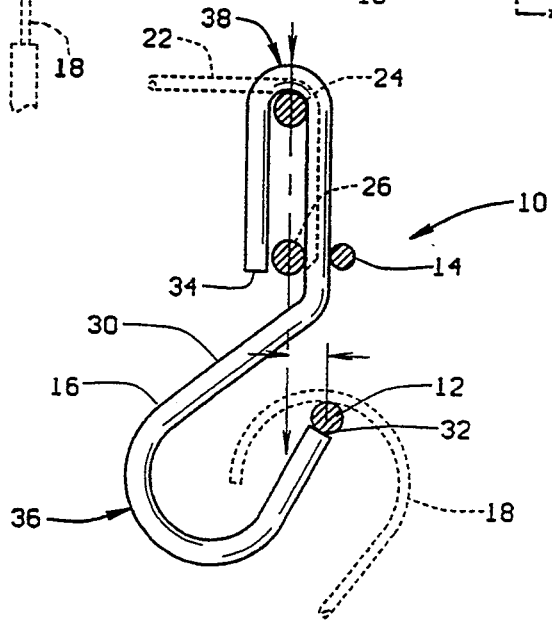
FIG. 4 is a cross-sectional view of the clothes hanger rod attachment of the invention taken in plane 4—4 of FIG. 3, with a wire shelf and the hook portion of a clothes hanger shown in phantom.

As best seen in FIG. 4, each support bracket 16 is comprised of a continuous stem 30 preferably formed from a single wire having opposite first 32 and second 34 terminal ends. However other materials, for example strips of metal or plastic, may be employed as the bracket stems. The first terminal end 32 of the support bracket is secured to an underside of the hanger rod 12 by welding or other equivalent means. From the attachment of the first terminal end 32 to the hanger rod 12, the bracket stem extends downwardly and rearwardly relative to the hanger rod through a U-shaped lower bend 36 formed in the stem generally below the hanger rod. From the lower bend 36 the stem of the support bracket then continues upwardly above the hanger rod 12 through an inverted U-shaped upper bend 38 positioned upwardly and rearwardly of the hanger rod. From the upper bend 38 the stem continues to its second terminal end 34.

The spacer rod 14 is attached to a forward portion of the upper bend 38 of each of the plurality of support brackets 16 by welding or other conventional means. The attachment of the hanger rod 12 and spacer rod 14 to each of the plurality of support brackets 16 gives rigidity and structural strength to the hanger rod shelf attachment 10.

As seen in FIG. 4, the upper inverted U-shaped bend 38 has a downwardly facing opening that is just wide enough to receive the vertically spaced transverse rods 24, 26 of the wire shelf assembly therein. The configuration of the lower U-shaped bend 36 of each of the support brackets positions the hanger rod 12 forward of the vertical plane V—V containing the vertically spaced transverse rods 24, 26 of the wire shelf assembly. When clothes hangers 18 are hung on the hanger rod 12, the positioning of the hanger rod forward of the vertical plane containing the vertically spaced wire shelf transverse rods 24, 26 will urge the support bracket 16 to rotate in a clockwise direction as viewed in FIG. 4 about the upper shelf transverse rod 24. The tendency of the support bracket 16 to rotate about the upper transverse rod 24 causes each of the support brackets to engage against a forward portion of the lower shelf transverse rod 26 and thereby prevents the rod shelf attachment 10 of the present invention from rattling or shaking forward and backward when in use suspended on the front transverse rods 24, 26 of a conventional wire shelf assembly.

As is also shown in drawing FIG. 4, the configuration of the lower U-shaped bend 36 of each of the support brackets enables the clothes hanger 18 suspended on the hanger rod 12 to slide freely over the entire length of the hanger rod without the support brackets 16 interfering with the sliding movement. Unlike conventional hanger rods of wire shelf assemblies, the configuration of the support brackets 16 described above enables the hanger rod shelf attachment 10 to be retrofit to existing wire shelf assemblies of various lengths and also enables clothes hangers 18 hung on the hanger rod 12 to slide along the entire length of the hanger rod without any interference from the support brackets 16 attached to the hanger rod.

Although the hanger rod shelf attachment 10 of the present invention has been described above as being retrofit to an existing wire shelf having a pair of vertically spaced forward transverse rods 24, 26, it should be understood that the rod shelf attachment 10 may also be employed with known wire shelf assemblies that comprise only a single forward transverse rod with the upper inverted U-shaped bends 38 in each of the support brackets attached over the single transverse rod.

While the present invention has been described by reference to specific embodiments, it should be understood that modifications and variations of the invention may be constructed without departing from the scope of the invention as defined in the following claims.

What is claimed is:

1. A clothes hanger rod assembly for removable attachment to at least one transverse wire of a wire shelf, the wire shelf having a plurality of horizontally spaced lateral wires attached to and traversed by the transverse wire, the assembly comprising:

a plurality of support brackets;

each support bracket comprising an upper hook, said upper hook being configured for removable attachment of the assembly to a transverse wire of a wire shelf, the upper hook being positioned between adjacent lateral wires of the wire shelf when the assembly is removably attached to the transverse wire;

each support bracket further comprising a lower hook, the lower hook being integral and continuous with the upper hook;

said hanger rod assembly further comprising a hanger rod permanently attached to each lower hook.

2. The clothes hanger rod assembly of claim 1, further comprising: a spacer rod parallel to the hanger rod and attached to the upper hooks.

3. The clothes hanger rod assembly of claim 1, wherein: the lower hook is configured so as to not interfere with the free sliding of clothes hangers hung on the hanger rod.

4. The clothes hanger rod assembly of claim 1, wherein: the support brackets are spaced so as to permit the attachment of the hanger rod assembly to various different wire shelf configurations.

5. The clothes hanger rod assembly of claim 1, wherein: the support brackets are configured to space the hanger rod forward of the transverse wire of a wire shelf.

6. A wire shelf and clothes hanger rod assembly, the assembly comprising:

a wire shelf comprised of a plurality of interconnected rods including a plurality of horizontally spaced lateral rods defining a shelf support surface and at least one transverse rod oriented perpendicular to the plurality of lateral rods;

an elongated hanger rod, the hanger rod having a length with opposite first and second ends;

at least a pair of support brackets connected to the hanger rod in a spaced relation to each other along the length of the hanger rod, each support bracket comprising a stem with opposite first and second ends, the first end of the stem is connected to the hanger rod, and the stem has a configuration where the stem extends from the first end through a U-shaped lower bend in the stem generally below the hanger rod, and then extends above the hanger rod to the second end of the stem; and, means on each support bracket stem for connecting the stem to the transverse rod of the wire shelf to suspend the support bracket and the hanger rod from the transverse rod of the wire shelf, and for disconnecting the stem from the transverse rod of the wire shelf to remove the support bracket and the hanger rod from the transverse rod.

7. The assembly of claim 6, wherein:

the means for connecting each support bracket stem to the transverse rod of the wire shelf is adapted to connect the stem to the transverse rod without using fasteners that are separable from the support bracket stem.

8. The assembly of claim 6, wherein: each support bracket stem is configured to suspend the hanger rod from the transverse rod of the wire shelf with the hanger rod positioned vertically below and horizontally forward of the transverse rod.

9. The assembly of claim 6, wherein: the means for connecting each support bracket stem to the transverse rod of the wire shelf includes an inverted U-shaped upper bend formed in the stem above the lower bend and the hanger rod, the upper bend of each support bracket having a configuration for hooking the upper bend of the stem over the transverse rod of the wire shelf to suspend the support bracket and the hanger rod from the transverse rod.

10. The assembly of claim 9, wherein: the stem of each support bracket is formed from a single wire.

11. The assembly of claim 9, wherein: the stem of each support bracket is configured to position the hanger rod below and forward of the transverse rod of the wire shelf the upper bend is hooked over.

12. The assembly of claim 9, wherein: the upper bend of each support bracket stem is configured for hooking the upper bend over a pair of vertically spaced transverse rods of the wire shelf to suspend the support bracket and hanger rod from the pair of transverse rods while preventing their rotation relative to the pair of transverse rods.

13. In a clothes hanger rod assembly of the type adapted for attachment to a wire shelf having at least one transverse rod, the improvement comprising:

an elongated hanger rod, the hanger rod having a longitudinal length with opposite first and second ends; and at least a pair of support brackets connected to the hanger rod in a longitudinally spaced relation to each other, each support bracket comprising a single wire with opposite first and second ends, the first end of the wire is connected to the hanger rod, and the wire has a configuration that extends from the first end of the wire through a U-shaped lower bend generally below the hanger rod, and then extends through an inverted U-shaped upper bend above the hanger rod to the second end of the wire.

14. The improvement of claim 13, wherein: the upper bend of each support bracket has a configuration for hooking the upper bend of the wire over a transverse rod of a wire shelf to suspend the support bracket and the hanger rod from the transverse rod without the use of fasteners that are separable from the support bracket.

15. The improvement of claim 13, wherein: the upper bend of each support bracket is configured for hooking the upper bend over a pair of vertically spaced transverse rods of a wire shelf to suspend the support bracket and hanger rod from the pair of transverse rods while preventing their rotation relative to the pair of transverse rods.

16. The improvement of claim 15, wherein: each support bracket has a configuration for suspending the hanger rod from the pair of transverse rods such that the hanger rod is positioned vertically below and horizontally forward of the pair of transverse rods.

17. The improvement of claim 13 wherein: each support bracket has a configuration for suspending the hanger rod from a transverse rod of a wire shelf such that the hanger rod is positioned vertically below and horizontally forward of the transverse rod.

18. The improvement of claim 13 wherein: the lower bend of each support bracket is configured so as to not interfere with the free sliding of clothes hangers along the length of the hanger rod.

19. The assembly of claim 6 wherein: the lower bend of each support bracket stem is configured so as to not interfere with the free sliding of clothes hangers hung on the hanger rod.

20. The clothes hanger rod assembly of claim 1, wherein: the upper hook is configured for removable attachment of the assembly to a pair of vertically spaced transverse wires of a wire shelf.

* * * * *